US005364103A

United States Patent [19]

Chen et al.

[11] Patent Number: 5,364,103

[45] Date of Patent: Nov. 15, 1994

[54] SPORTS EQUIPMENT FOR GOLF-LIKE GAME

[75] Inventors: Mao-Lan Chen; Da-Chung Chen, both of Kaohsiung, Taiwan, Prov. of China

[73] Assignee: Love-Blue Enterprise Co., Ltd., Kaohsiung, Taiwan, Prov. of China

[21] Appl. No.: 152,235

[22] Filed: Nov. 16, 1993

[51] Int. Cl.[5] ..... A63B 53/00; A63B 49/00

[52] U.S. Cl. ..... 273/193 R; 273/167 R; 273/58 R; 273/73 R; 273/73 C

[58] Field of Search ..... 273/193 R, 193 A, 194 R, 273/167 R, 73 R, 73 C, 35 R, 58 R, 62, 233, 67 R

[56] References Cited

U.S. PATENT DOCUMENTS 4,026,561 5/1977 Baldorossi et al. ..... 273/193 R
4,241,918 12/1980 Massino ..... 273/58 A X
4,478,416 10/1984 Gibello ..... 273/73 C
4,858,928 8/1989 Muroi et al. ..... 273/73 D
4,934,704 6/1990 Mazer ..... 273/176 F

FOREIGN PATENT DOCUMENTS 2060405 5/1981 United Kingdom ..... 273/194 R

*Primary Examiner*—Raleigh W. Chiu
*Attorney, Agent, or Firm*—Browdy and Neimark

[57] ABSTRACT

An improved sports equipment for golf-like game has a club in combination with at least one fluffy ball. The ball is rather light in weight and soft in structure and has a ball-shaped leather cover and is stuffed with soft material inside, such as feather, cotton or cloth so that it will not do any harm to people who are accidentally hit by such a ball. The club has a racquet-like head having a putting block secured to the bottom edge thererof. The present sports equipment permit people to practice golf game at any available place and at any time.

5 Claims, 3 Drawing Sheets

SPORTS EQUIPMENT FOR GOLF-LIKE GAME

BACKGROUND OF THE INVENTION

The present invention relates to a putting game equipment including a club having a racquet-like head and fluffy balls each stuffed with soft feather or material of the like. In playing the game, a player can either putt or hit with force on a fluffy ball which will move or fly away. Each fluffy ball has an outer cover made of leather or material of the like and the stuffed feather is enclosed therein so that it is rather light in weight and is harmless to people even when they are accidentally hit by such a fluffy ball.

The putting game of the present invention can be played at places like a park, a playground of school, grass lawn, a field, a beach, a court and even a snow-covered ground; and people of any age can enjoy the game by playing it at any available place.

Conventional golf ball must be played with at least a club and a hard golf ball, not mentioning a rather spacious grass court. The golf ball is rather hard and can fly with high speed when hit with force, making it fatally dangerous to people in the range of playing when hit by accident. Besides, the equipment for golf playing is rather expensive and the cost for each playing in a standard field is relatively high.

SUMMARY OF THE INVENTION

Therefore, the primary of the present invention is to provide a putting game equipment having a club with a racquet-like head and at least a fluffy ball.

Another object of the present invention is to provide a putting game equipment which permits people of any age to play golf-like game at any place at any time.

DETAILED DESCRIPTION OF THE PREFERRED EMBODIMENT

Figure 1:
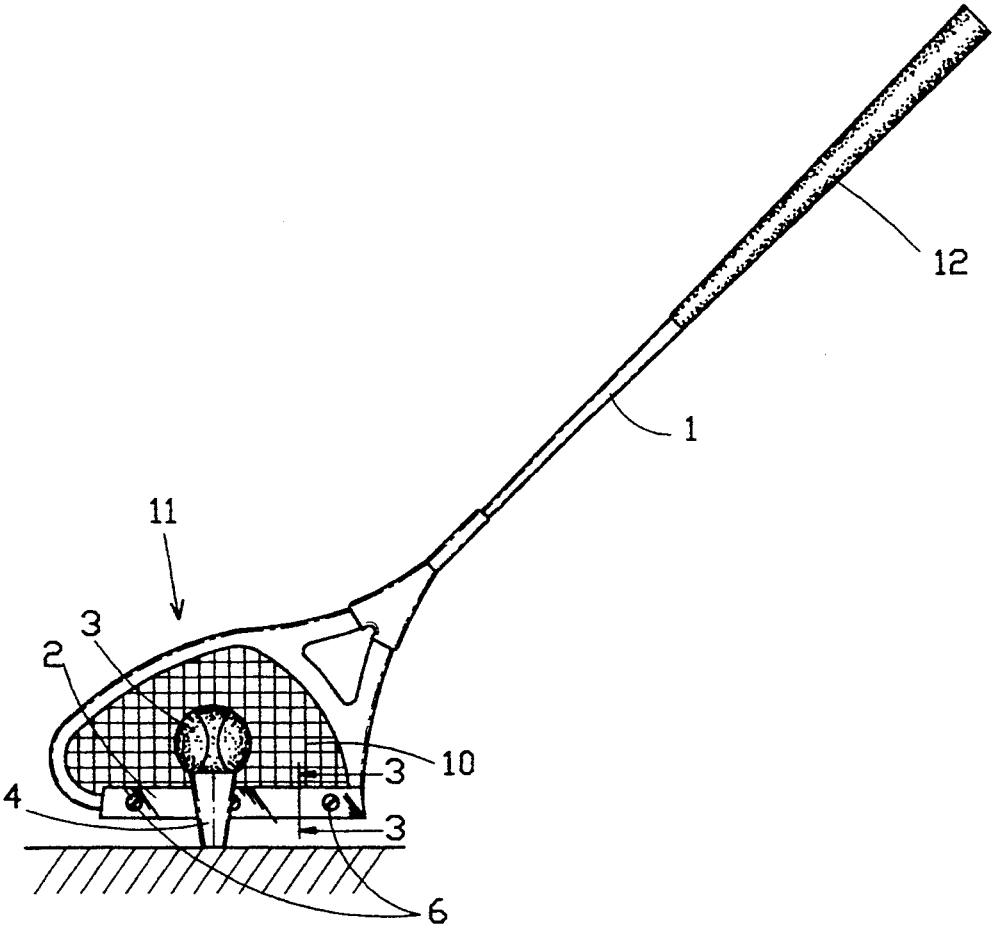
FIG. 1 is a diagram showing the club and fluffy ball of the present invention mounting on a tee.
Figure 5:
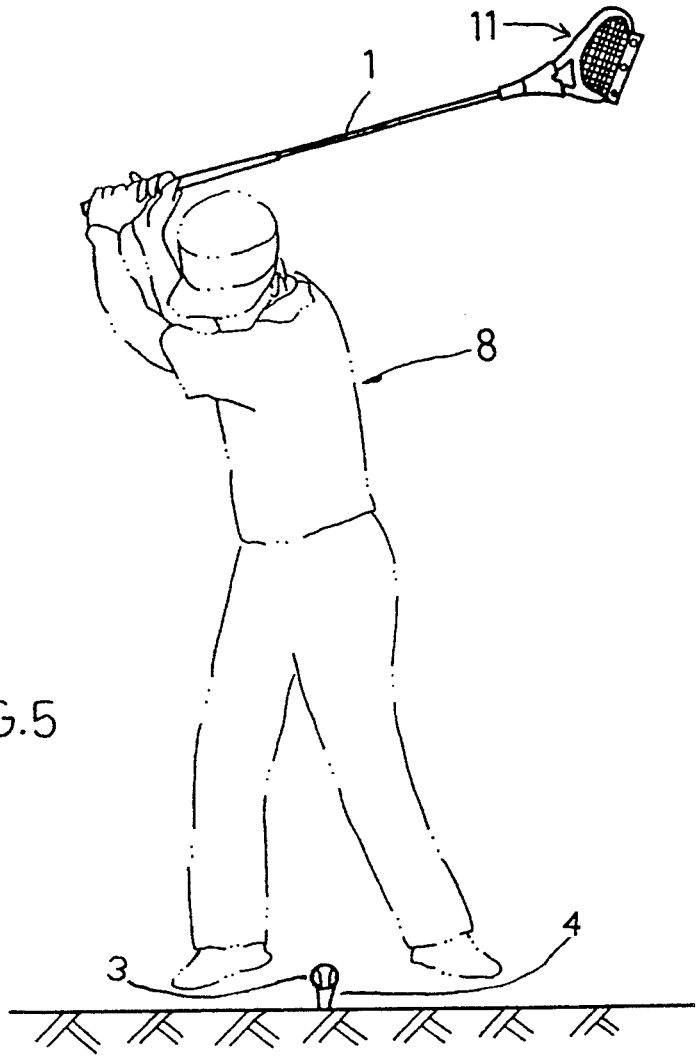
FIG. 5 is a diagram showing the swing of the club by a player against a fluffy ball.

FIGS. 1 and 5 show a tee 4 fixed to the ground with a fluffy ball 3 mounted thereto, and when a club 1 having a racquet-like head 11 with a frame, conventional ball striking surface 10, and putting block 2 secured to the edge of the head 11. When club 1 is moved against the fluffy ball by player 8 as shown in FIG. 5, surface 10 strikes the ball and making the same roll toward a target.

Figure 2:
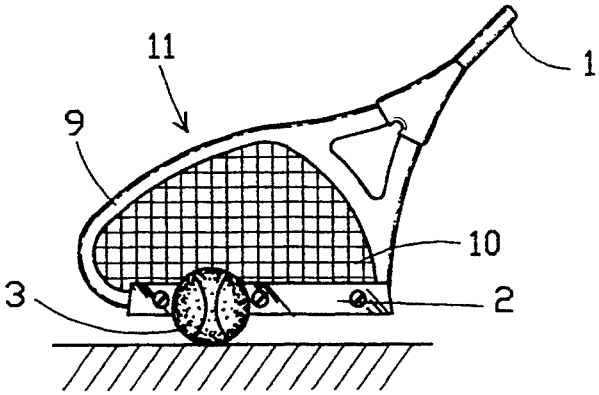
FIG. 2 is a diagram showing another way of playing the ball on the ground.
Figure 5A:
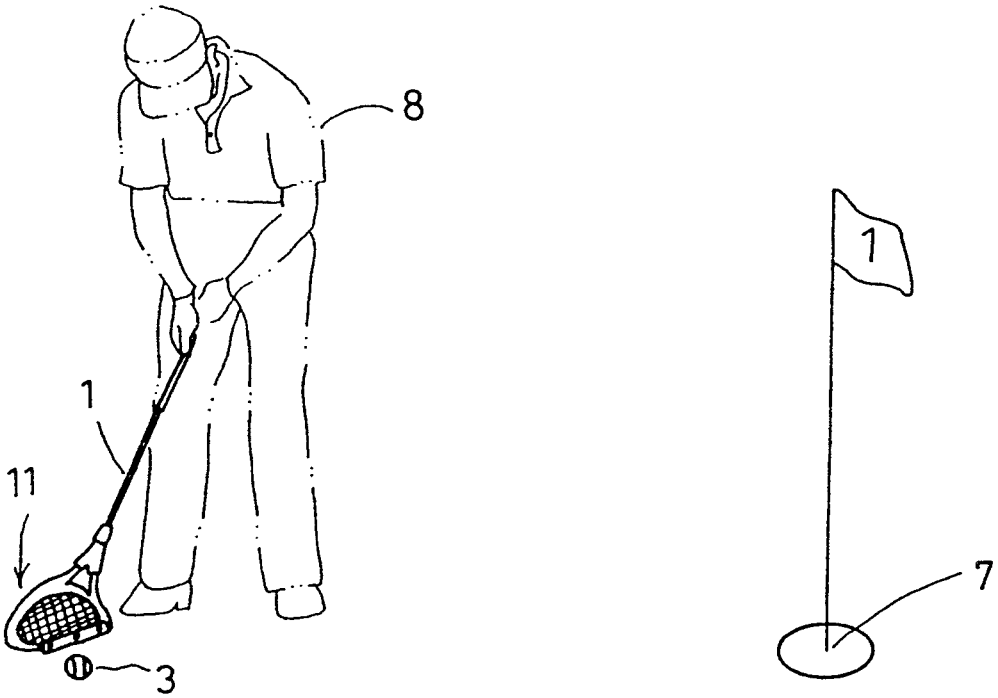
FIG. 5A is a diagram showing the putting of a fluffy ball toward a target.

As further shown in FIG. 2 and FIG. 5A, when the fluffy ball 3 has landed on the ground and is located at a spot near a target hole 7 or a marked circle, the club 1 is aligned with the putting block 2 which moves against the fluffy ball 3 so that the ball can roll slowly and steadily toward the target 7.

Figure 3:
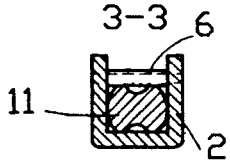
FIG. 3 is a sectional view of FIG. 1 taken along line 3—3.
Figure 4:
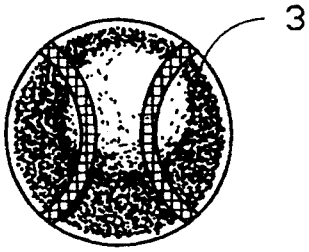
FIG. 4 is a diagram showing a fluffy ball of the present invention.
Figure 4A:
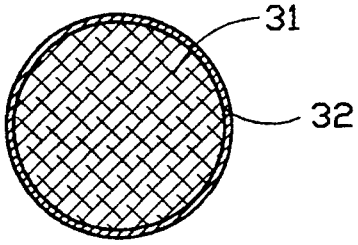
FIG. 4A is a sectional view of the fluffy ball.

Referring to FIG. 3, the putting block 2 is secured to the edge of the racquet-like head 11 by screws 6. As further shown in FIG. 4A, the fluffy ball 3 is stuffed with feathers 31 inside and the cover 32 is made of leather 32 sewed into a ball form.

The handle 12 is removably secured to the club 1 so that the length of the club can be adjustably varied by attaching different sized handle to the club 1, permitting adults and children of different height to hold the club 1 with ease and comfort.

It is obviously seen that the present invention has the following advantages:

1. It is a fit-for-all sports equipment and can be fun to all members of a family playing together.
2. It can be played by people of all ages.
3. It is easy to learn and play.
4. It helps people practice golf game skills at any available place.
5. It provides a skillful, sportive and entertaining game.

We claim:

1. Improved sports equipment for a player of a game, said sports equipment comprising:

a club in combination with at least one fluffy ball, said club including a shaft fixed to a periphery of a racket head having a ball striking surface for striking said fluffy ball, an axis of said shaft being in the same plane as said racket head, a putting block secured to said periphery;

a longitudinal axis of said putting block being at an acute angle to said axis of said shaft when said putting block is secured to said periphery, said putting block having a height which allows a player to strike said fluffy ball with said ball striking surface when set on a tee and with said putting block when set on the ground, said fluffy ball having a ball shaped cover with soft material stuffed inside.

2. The sports equipment as claimed in claim 1 wherein said soft material is feathers or cotton.

3. The sports equipment as claimed in claim 1 wherein said ball shaped cover is made of leather.

4. The sports equipment as claimed in claim 3 wherein said ball shaped cover made of leather is soft.

5. The sports equipment as claimed in claim 1 wherein said ball shaped cover is made of soft material.

* * * * *